United States Patent [19]

O'Brien et al.

[11] Patent Number: 4,631,392

[45] Date of Patent: Dec. 23, 1986

[54] FLEXIBLE HIGH TEMPERATURE HEATER

[75] Inventors: Michael T. O'Brien, Union City; Umesh K. Sopory, San Jose; Shou-Mean Fang, Union City, all of Calif.

[73] Assignee: Raychem Corporation, Menlo Park, Calif.

[21] Appl. No.: 630,792

[22] Filed: Jul. 13, 1984

[51] Int. Cl.[4] ..... H05B 3/34

[52] U.S. Cl. ..... 219/549; 219/544; 219/553; 338/214; 174/102 SC

[58] Field of Search ..... 219/523, 530, 528, 541, 219/544, 549, 553; 338/22 R, 22 SD, 214, 208; 174/36, 102 R, 102 SC, 102 D, 105 SC, 106 SC, 126 S, 138 J

[56] References Cited

U.S. PATENT DOCUMENTS

| | | | |
|---|---|---|---|
| 2,494,589 | 1/1950 | Sletner | 338/214 X |
| 2,528,966 | 11/1950 | Moore et al. | 338/214 X |
| 2,764,659 | 9/1956 | Postal | 219/214 X |
| 3,173,990 | 3/1965 | Lamons | 174/102 D |
| 3,557,301 | 1/1971 | Priaroggia | 174/102 D |
| 3,582,536 | 6/1971 | Miller | 174/102 D |
| 3,602,622 | 8/1971 | Miller et al. | 174/36 |
| 4,037,083 | 7/1977 | Leavines | 219/552 |
| 4,069,410 | 1/1978 | Keep, Jr. | 219/530 X |
| 4,072,848 | 2/1978 | Johnson et al. | 219/528 |
| 4,242,573 | 12/1980 | Batliwalla | 219/528 |
| 4,297,526 | 10/1981 | Leuch et al. | 174/102 D X |
| 4,425,497 | 1/1984 | Leary et al. | 219/544 |

FOREIGN PATENT DOCUMENTS

| | | | |
|---|---|---|---|
| 472621 | 12/1914 | France | 338/214 |
| 562867 | 7/1944 | United Kingdom | 338/214 |
| 632235 | 11/1949 | United Kingdom | 338/214 |

*Primary Examiner*—E. A. Goldberg
*Assistant Examiner*—M. M. Lateef
*Attorney, Agent, or Firm*—Stephen C. Kaufman; Herbert G. Burkard; Timothy H. P. Richardson

[57] ABSTRACT

An assembly comprising a flexible corrugated metal tube and an elongate resistive heating element that is within the tube and which can be connected to a power supply to provide an elongate electrical heater. The tube has a wall thickness less than 0.012 inch, a corrugation depth greater than 0.030 inches and a distance between corresponding points in adjacent corrugations from 0.02 inch to 0.75 inch. The corrugations extend around the entire periphery of the tube.

10 Claims, 1 Drawing Figure

FLEXIBLE HIGH TEMPERATURE HEATER

BACKGROUND OF THE INVENTION

1. Field of the Invention

This invention relates to flexible high temperature heaters.

2. Introduction to the Invention

High temperature heaters are well known and typically include a metallic sheath around the heater. A serious disadvantage of such heaters is that they lack the flexibility which is desirable or necessary in many applications. Reference may be made for example to U.S. Pat. Nos. 4,037,083 and 4,100,673 and commonly assigned U.S. Ser. Nos. 457,295 (Morrow) and the application filed on July 19, 1984 by Wells Whitney Ser. No. 632,776. The disclosure of each of those patents and patent applications is incorporated herein by reference. The term "high temperature heater" is used herein to denote a heater which is capable of being maintained at a temperature of at least 600° F. on a sustained basis.

SUMMARY OF THE INVENTION

I have now discovered that substantial improvements and advantages, in particular excellent flexibility, can be provided in the performance and application of high temperature heaters by providing an assembly comprising (a) a flexible corrugated metal tube, the corrugation extending around the entire periphery of the tube, the tube having a wall thickness less than 0.012 inch, a corrugation depth greater than 0.030 inches and a distance between corresponding points on adjacent corrugations from 0.02 inch to 0.75 inch; and (b) an elongate resistive heating element that is within the tube and which can be connected to a power supply to provide an elongate electrical heater.

In another aspect of the invention there is provided a method of heating a substrate comprising (1) placing adjacent the substrate an assembly comprising (a) a flexible corrugated metal tube, the corrugation extending around the entire periphery of the tube, the tube having a wall thickness less than 0.012 inch, a corrugation depth greater than 0.030 inches and a distance between corresponding points on adjacent corrugations from 0.02 inch to 0.75 inch; and (b) an elongate resistive heating element that is within the tube and which can be connected to a power supply to provide an elongate electrical heater; and (2) connecting the heating element to a power supply.

BRIEF DESCRIPTION OF THE DRAWING

The invention is illustrated in the accompanying drawing in which.

DETAILED DESCRIPTION OF THE INVENTION

Figure 1:
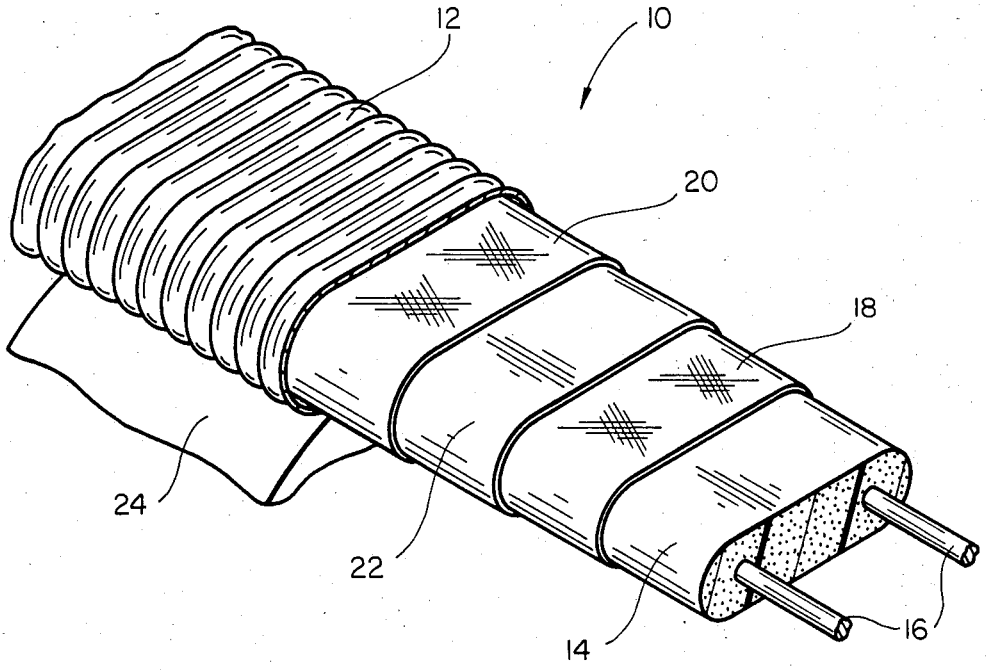
FIG. 1 provides a perspective view of the assembly of the invention.

As indicated above, the corrugations of the flexible corrugated tube extend around the entire periphery of the tube. Preferably, the corrugations follow a helical path. The corrugated tube has an elliptical cross-section. The tube is impervious to air. The invention is particularly useful for heating a substrate which is located in a hazardous location, the heating element then being connected to the power supply by means of terminations which are within a junction box which will prevent flames generated within the junction box from reaching the atmosphere surrounding the junction box. The heater if suitably terminated is then satisfactory for use when an explosion proof installation is required. Such impervious tubing is preferably made by deformation of a continuous non-corrugated tube. The tube preferably has a wall thickness less than 0.012 inch, especially 0.004 to 0.008 inch; a corrugation depth greater than 0.030 inches, especially 0.050 to 0.090 inch; and a distance between corresponding points in adjacent corrugations from 0.02 to 0.75 inch, especially 0.1 to 0.3 inch. Preferably, the corrugated tube comprises an alloy of nickel, cobalt and iron, or, an alloy of copper and nickel, or, stainless steel.

The elongate resistive heating element that is within the tube preferably comprises a pair of flexible elongate parallel conductors with resistive elements connected in parallel between them. The heating element can include a plurality of such heating modules. The heating element preferably comprises an insulating jacket which comprises an inner glass layer, an outer glass layer, and a mica layer sandwiched between the inner and outer glass layers.

The heating element can be connected to a power supply to provide an elongate heater, e.g. an elongate self-regulating electrical heater. The heating element can be adapted to be connected to an AC or DC power supply.

Attention is now directed to FIG. 1 which provides a perspective view of an assembly 10 of the invention. The assembly 10 includes a flexible corrugated metal tube 12 and an elongate resistive heating element 14 that is within the tube 12. The heating element 14 comprises a pair of flexible elongate parallel conductors 16 with resistive elements 14 connected in parallel between them. Also shown in FIG. 1 is an insulating jacket which comprises an inner glass layer 18, an outer glass layer 20 and a mica layer 22 sandwiched between the inner and outer layers 18 and 20 respectively.

The assembly 10 is advantageously employed by placing it adjacent a substrate 24 to be heated and connecting the heating element 14 to a power supply (not shown). Note that the corrugations extend around the periphery of the tube 12 and that this important feature helps provide the following advantages:

(1) the assembly 10 easily bends around the substrate 24 (and valves and flanges as well) having a relatively small diameter, e.g. ½ inch pipe;

(2) the assembly 10 can take repeated applications of bending and flexing without kinking or breaking, e.g. cycles of 15–25 with 180° flexing; and (3) the relatively larger surface area of the assembly 10 due to the corrugations provides a lower surface or sheath temperature for a given power output (or, equivalently, the heating element 14 can deliver more power at a given sheath temperature); this, in turn, is a major advantage in refineries and process plants where heater sheath temperature (called T rating) should be kept as low as possible.

We claim:

1. A method of heating a substrate, which method comprises placing adjacent the substrate and in thermal contact therewith an assembly comprising (a) a flexible corrugated metal tube which is impervious to air, which has an elliptical cross-section and which has been made by deformation of a continuous non-corrugated tube, the metal of the metal tube being selected from the group consisting of an alloy of nickel, cobalt and iron, an alloy of copper and nickel, and stainless steel; the corrugations extending around the entire periphery of the tube, the tube having a wall thickness less than 0.012 inch, the depth of the corrugations being greater than 0.030 inch and the distance between corresponding points on adjacent corrugations being from 0.02 inch to 0.30 inch; and (b) an elongate high temperature resistive heating element which is within the tube, which is thermally coupled to the tube and electrically insulated from the tube and which is connected to an AC power supply so that it is maintained at a temperature of 600° F. or more.

2. A method according to claim 1, wherein the heating element is electrically insulated from the metal tube by an insulating jacket which comprises (a) an inner glass layer;

(b) an outer glass layer; and (c) a mica layer sandwiched between the inner and outer glass layers.

3. A method according to claim 1, wherein the corrugated tube has corrugations that follow a helical path.

4. A method according to claim 1, wherein the tube has a wall thickness from 0.004 to 0.008 inches.

5. A method according to claim 1, wherein the tube has a corrugation depth from 0.050 to 0.090 inches.

6. A method according to claim 1, wherein the distance between corresponding points in adjacent corrugations is from 0.1 to 0.3 inches.

7. A method according to claim 1, wherein the heating element comprises a pair of flexible elongate parallel conductors with resistive elements connected in parallel between them.

8. A method according to claim 7, wherein the heating element is an elongate self-regulating electrical heater.

9. A method according to claim 7, wherein the heating element comprises a plurality of discrete heating modules comprising said resistive elements.

10. A method according to claim 1, wherein the substrate is located in a hazardous location, and the heating element is connected to the power supply by means of terminations which are within a junction box which will prevent flames generated within the junction box from reaching the atmosphere surrounding the junction box.

* * * * *